US011408237B2

(12) United States Patent
Norrid et al.

(10) Patent No.: US 11,408,237 B2
(45) Date of Patent: Aug. 9, 2022

(54) SELF METERING SETTING TOOL HAVING INTEGRATED WIRELINE ADAPTER KIT FUNCTIONALITY

(71) Applicant: SCHLUMBRGER TECHNOLOGY CORPORATION, Sugar Land, TX (US)

(72) Inventors: William Norrid, Fulshear, TX (US); Sidney Jasek, Hallettsville, TX (US); Michael Dardis, Richmond, TX (US); Isaac Aviles Cadena, Sugar Land, TX (US); Robert Matthew Graham, Houston, TX (US); Roberto Jaime, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/599,381

(22) Filed: Oct. 11, 2019

(65) Prior Publication Data

US 2020/0115977 A1 Apr. 16, 2020

Related U.S. Application Data

(60) Provisional application No. 62/744,670, filed on Oct. 12, 2018.

(51) Int. Cl.

| | |
|---|---|
| ***E21B 23/04*** | (2006.01) |
| ***E21B 23/06*** | (2006.01) |
| ***E21B 33/12*** | (2006.01) |

(52) U.S. Cl.
CPC ..... *E21B 23/065* (2013.01); *E21B 33/12* (2013.01); *E21B 23/04* (2013.01)

(58) Field of Classification Search
CPC ..... E21B 23/04; E21B 23/065; E21B 33/12; E21B 33/134
See application file for complete search history.

(56) References Cited

U.S. PATENT DOCUMENTS

| | | | | |
|---|---|---|---|---|
| 3,002,559 | A * | 10/1961 | Hanes | E21B 23/065 166/63 |
| 3,387,659 | A * | 6/1968 | Current | E21B 33/134 166/125 |
| 9,810,035 | B1 | 11/2017 | Carr et al. | |
| 10,934,794 | B2 * | 3/2021 | Knight | E21B 23/065 |
| 10,934,795 | B2 * | 3/2021 | Wells | E21B 23/06 |
| 11,066,886 | B2 * | 7/2021 | Mickey | E21B 23/065 |
| 2007/0151722 | A1 * | 7/2007 | Lehr | E21B 23/06 166/123 |
| 2020/0115977 | A1 | 4/2020 | Norrid et al. | |

* cited by examiner

*Primary Examiner* — D. Andrews
(74) *Attorney, Agent, or Firm* — Matthew Goode

(57) ABSTRACT

A technique facilitates improved setting of downhole devices, e.g. frac plugs. The technique utilizes a setting tool, e.g. a disposable setting tool, which integrates the functionality of a wireline adapter kit to provide a compact disposable solution for setting downhole devices. The setting tool comprises a self metering system which slows an otherwise violent setting action to a controlled setting sequence. The self metering system enables avoidance of the use of slow burn charges sometimes used in conventional setting tools.

14 Claims, 1 Drawing Sheet

SELF METERING SETTING TOOL HAVING INTEGRATED WIRELINE ADAPTER KIT FUNCTIONALITY

BACKGROUND

In many hydrocarbon well applications, various types of tools may be delivered downhole and set in a wellbore. For example, frac plugs or other types of sealing devices may be delivered downhole via wireline and set against a surrounding wellbore surface. The setting may be accomplished by a wireline adapter kit coupled with a wireline setting tool. A firing head, coupled with the wireline, is used to actuate an explosive which drives the setting tool so as to set the sealing device, e.g. plug, in the wellbore. However, the combination of the wireline adapter kit and the separate setting tool can create complexity and is generally unable to slow down the setting speed.

SUMMARY

In general, a methodology and system are provided which facilitate improved setting of downhole devices, e.g. frac plugs. The technique utilizes a setting tool, e.g. a disposable setting tool, which integrates the functionality of a wireline adapter kit to provide a compact disposable solution for setting downhole devices. The setting tool comprises a self metering system which slows an otherwise violent setting action to a controlled setting sequence. The self metering system enables avoidance of the use of slow burn charges sometimes used in conventional setting tools.

A system to facilitate actuation in a borehole according to one or more embodiments of the present disclosure includes a device deployed via a wireline coupled with a firing head; and a setting tool operatively coupled with the device to actuate the device to a set position in the borehole. The setting tool according to one or more embodiments of the present disclosure includes an outer housing having metering ports; a gauge ring disposed at one end of the outer housing; a seal cap disposed at an opposite end of the outer housing; a tension member slidably and sealably mounted within the outer housing and through the seal cap and the gauge ring, the tension member having passages in communication between an interior of the tension member and a pressure chamber formed between the tension member and the housing; and a setting charge disposed in the interior of the tension member, the passages directing expanding gas to the pressure chamber upon initiation of the setting charge, the expanding gas driving the outer housing linearly with respect to the tension member to set the device while the metering ports control discharge of fluid from the outer housing to limit stroke speed of the outer housing relative to the tension member.

A method to facilitate actuation in a borehole according to one or more embodiments of the present disclosure includes deploying a device and a setting tool operatively coupled with the device via a wireline to a desired location in the borehole; and actuating the device to a set position in the borehole with the setting tool. According to one or more embodiments of the present disclosure, the setting tool includes an outer housing having metering ports; a gauge ring disposed at one end of the outer housing; a seal cap disposed at an opposite end of the outer housing; a tension member slidably and sealably mounted within the outer housing and through the seal cap and the gauge ring, the tension member having passages in communication between an interior of the tension member and a pressure chamber formed between the tension member and the housing; and a setting charge disposed in the interior of the tension member. According to one or more embodiments of the present disclosure, the step of actuating the device further includes initiating the setting charge via a fire head coupled to the setting tool; allowing expanding gas resulting from the setting charge to flow through the passages of the tension member into the pressure chamber; and using the expanding gas to drive the outer housing linearly with respect to the tension member to set the device while controlling discharge of fluid from the outer housing with the metering ports to limit stroke speed of the outer housing relative to the tension member.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system which facilitate improved setting of downhole devices. Examples of such downhole devices include frac plugs, other types of plugs, packers, or other devices which may be deployed via wireline and set downhole. The technique utilizes a setting tool which integrates the functionality of a wireline adapter kit to provide a compact disposable solution for setting downhole devices.

In a variety of applications, the setting tool is constructed and utilized as a disposable setting tool. Furthermore, the setting tool comprises a self metering system which slows an otherwise violent setting action to a controlled setting sequence. Slow burn charges are sometimes used in conventional setting tools, but the setting tool described herein enables employment of various types of charges for setting many types of tools downhole (without utilizing slow burn charges).

By integrating the functionality of a wireline adapter kit into the setting tool, the cost and length of the overall setting tool is reduced compared to separate setting tools and wireline adapter kits. Additionally, the use of a self filling metering system slows the setting rate to a desired speed without having to use slow burn charges. The self filling metering system also simplifies the assembly and eliminates oil addition. The configuration of the setting tool system also shifts risk from field environments to manufacturing environments where better control and a centralized quality assurance/quality control may be implemented.

Various settable devices, e.g. plugs, may be set via different types of actuation. By way of example, some settable devices utilize an outer setting sleeve which pushes down while an inner member holds still to enable setting of the device. An embodiment described below operates in this fashion by holding an inner member while an outer setting sleeve is moved in a linear, e.g. downwardly, setting motion.

Figure 1:
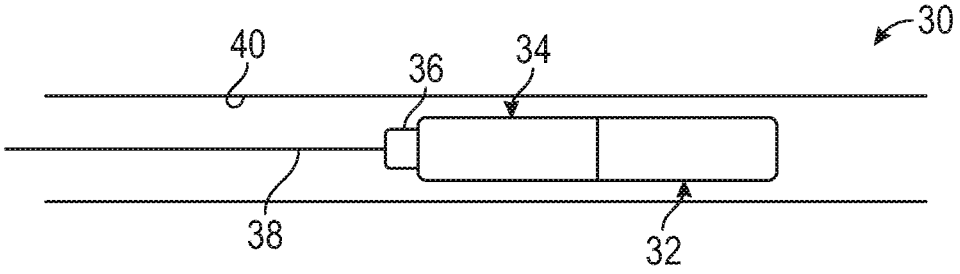
FIG. 1 is a schematic illustration of a settable device, e.g. a plug, coupled with a setting tool and being deployed in a borehole via wireline, according to an embodiment of the disclosure.

Referring generally to FIG. 1, a schematic illustration shows an example of a well system 30 having a settable device 32, e.g. a frac plug or other settable plug, coupled with a setting tool 34. The setting tool 34 integrates the functionality of a wireline adapter kit and may be coupled with a firing head 36 and a wireline 38. The wireline 38 may be used with a variety of other tools and components to facilitate conveyance of the settable device 32 to a desired location along a borehole 40, e.g. a wellbore. The setting tool 34 is then actuated to set the device 32 by, for example, expanding the device 32 into sealing engagement with the surrounding borehole surface, e.g. a surrounding casing surface or other tubing surface. The setting tool 34 may be actuated after appropriate signals are sent via wireline 38 to the firing head 36 to cause initiation, e.g. detonation, of suitable charges within setting tool 34.

Figure 2:
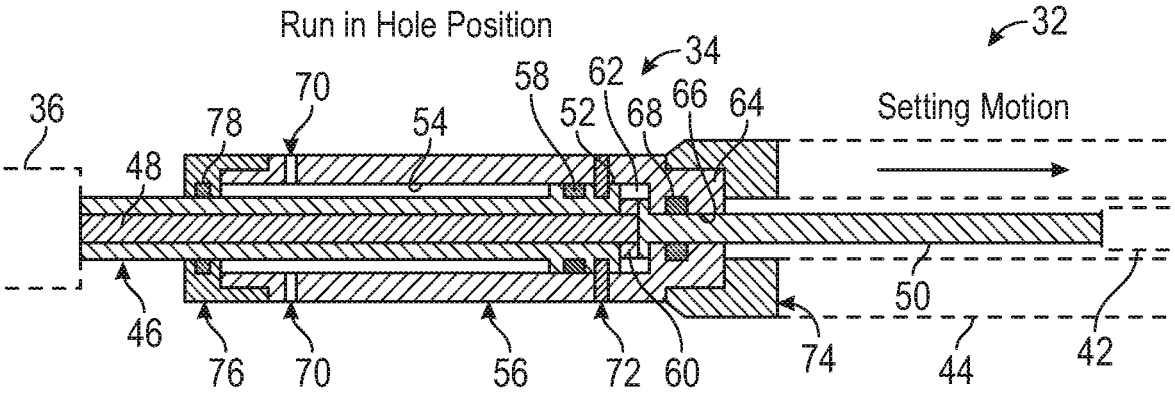
FIG. 2 is a cross-sectional illustration of an example of a setting tool integrating the functionality of a wireline adapter kit, according to an embodiment of the disclosure.

Referring generally to FIG. 2, an example of setting tool 34 is illustrated. In this embodiment, setting tool 34 is operatively coupled with settable device 32 via an inner member 42 and an outer setting sleeve 44 which is shifted relative to the inner member 42 by the setting tool 34. At an opposite end, the setting tool 34 may be coupled with firing head 36.

In the illustrated embodiment, the setting tool 34 comprises a tension member 46 which contains a setting charge 48 and attaches to firing head 36 of wireline 38. The tension member 46 also may comprise a tension rod portion 50 which may be coupled with inner member 42 of device/plug 32. The tension rod portion 50 may be a unitary portion of the tension member 46 or a separate component attached to the tension member 46.

The tension member 46 also may comprise a piston portion 52 sealably and slidably engaged with a corresponding inner surface 54 of an outer housing 56. For example, a seal 58 to be positioned between the piston portion 52 and the outer housing 56. The tension member 46 and outer housing 56 cooperate to transfer combustion pressure, upon initiation of setting charge 48, into linear force so as to actuate and set device 32.

As illustrated, the setting charge 48 is contained within an interior of the tension member 46 and communicates, via a passage or passages 60, with a pressure chamber 62. The pressure chamber 62 is disposed between tension member 46 and outer housing 56 and between piston portion 52 and an end 64 of outer housing 56. The tension rod portion 50 slidably extends through a longitudinal passage 66 formed through housing end 64. The tension rod portion 50 may be sealed with respect to the housing end 64 via a seal 68.

As further illustrated in FIG. 2, the outer housing 56 also comprises at least one metering port 70, e.g. a plurality of metering ports 70. The metering ports 70 may be in the form of passages extending laterally through a wall of outer housing 56 between an interior and an exterior of the outer housing 56. It should be noted the tension member 46 may initially be held in position relative to outer housing 56 via at least one shear member 72, e.g. a plurality of shear screws. In the illustrated example, the shear screws 72 extend between outer housing 56 and piston portion 52.

The setting tool 34 also may comprise a gauge ring 74 constructed for proper standoff and adjustment. By way of example, the gauge ring 74 may be coupled with the outer setting sleeve 44 to facilitate actuation and setting of device 32. The outer housing 56 also may be combined with or may comprise a seal cap 76. The seal cap 76 may be coupled with, e.g. welded or threadably coupled with, a main portion of the outer housing 56 at an opposite end of the outer housing 56 relative to housing end 64. A seal 78 may be located between seal cap 76 and tension member 46.

The seal cap 76 closes off outer housing 56 to effectively force fluid through the metering ports 70 as the fluid flows into/out of outer housing 56. It should be noted the metering ports 70 also can be located through seal cap 76 if there is sufficient space. The metering ports 70 enable self filling of the volume within outer housing 56 between piston portion 52 and seal cap 76 during running in hole. The metering ports 70 also serve to slow the setting process, e.g. slow the stroke speed, upon initiation of setting charge 48 regardless of the type of setting charge used to actuate device 32.

In an operational example, the device/plug 32 and setting tool 34 are deployed via wireline 38 to a desired location along wellbore 40. While the device 32 and setting tool 34 are running in hole, fluid flows into outer housing 56 through metering ports 70. In other words, the outer housing 56 self fills with fluid.

Once the device 32 is at a desired location, signals are provided to firing head 36 to initiate the setting charge 48. The setting charge 48 burns inside tension member 46 and gases expand and flow through passages 60 into the pressure chamber 62 located between seals 58 and 68. Upon sufficient pressure buildup, the shear member 72 is sheared and the outer housing 56 moves in a setting motion, e.g. moves downwardly, relative to tension member 46 as a result of the expanding gases.

Figure 3:
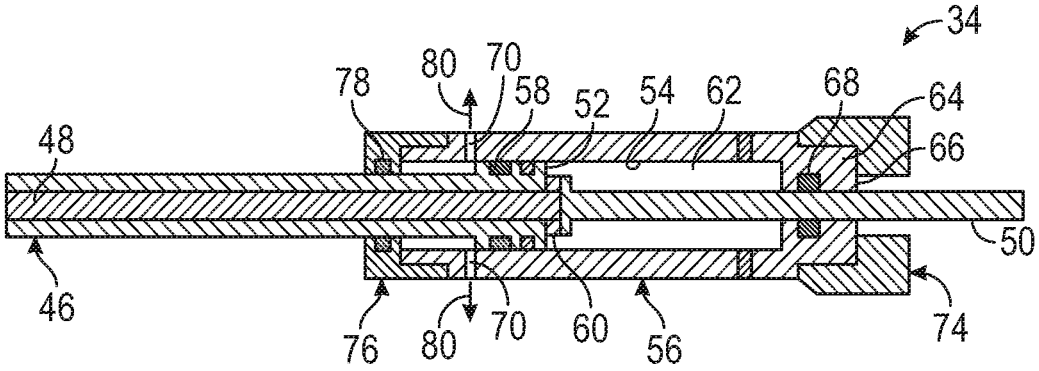
FIG. 3 is a cross-sectional illustration similar to that of FIG. 2 but in a different operational position, according to an embodiment of the disclosure.

As the outer housing 56 moves relative to tension member 46, the piston portion 52 forces fluid out through metering ports 70 (as illustrated by arrows 80 in FIG. 3) to control stroke speed. In this example, the fluid forced out through metering ports 70 is the same fluid that "self filled" outer housing 56 between piston portion 52 and seal cap 76. The relative motion between tension member 46 and outer housing 56 causes the relative linear motion (setting motion) between inner member 42 and outer setting sleeve 44 so as to set and release the device/plug 32. As the tension member 46 and outer housing 56 reach a maximum stroke position, gas pressure may be released through an appropriate pressure release, e.g. through a slot in the tension member 46.

It should be noted the metering port(s) 70 may have a variety of configurations to achieve a suitable metering system for controlling stroke speed. The metering port(s) 70 may be structured in a variety of tortuous paths to restrict fluid movement and may be embodied in a variety of nozzles, orifices, indirect paths, valves, seals, and/or other suitable devices.

As previously described, a wireline adapter kit may be integrated into a disposable setting tool according to one or more embodiments of the present disclosure. The disposable setting tool that integrates the functionality of the wireline adapter kit may be assembled at the factory or in the field in one or more embodiments of the present disclosure. Advantageously, factory assembly improves reliability and reduces the risk of incorrect assembly in the field. Further, the integrated designs reduce the number of parts, streamline assembly of the plug onto the wireline running tool or adapter kit, and alleviate maintenance costs.

In addition to the embodiments of the disclosure as previously described, a separate standalone wireline adapter kit may be used with either a standard setting tool or a disposable setting tool according to one or more embodiments of the present disclosure. That is, wireline running tools or adapter kits, which are currently semi-permanent parts, may be designed to be one-time-use parts in accordance with one or more embodiments of the present disclosure. Redesigning the parts from semi-permanent to one-time use has several advantages. First, all adapter kit-related maintenance costs are eliminated. That is, the kits are no longer designed for maintainability or longevity. The sole purpose of the part is to function reliably for low cost. Second, a lower grade of material may be used for the components in some cases. Third, if integrated into a one-time-use or disposable setting tool, there is potential to combine or eliminate certain components, which would reduce cost and simplify assembly. Fourth, the operation of installing the settable device (e.g., plug) onto the adapter kit could be moved from the field to the factory to improve reliability. The one-time-use adapter kit may be designed for use with a standard setting tool, or with a disposable setting tool as previously described, according to one or more embodiments of the present disclosure. In either configuration, some or all of the aforementioned advantages may be realized. In one or more embodiments of the present disclosure, the adapter kit may be disposed of after use or some of the components may be recycled and refurbished into new kits.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system to facilitate actuation in a borehole, comprising:

a device deployed via a wireline coupled with a firing head;

a setting sleeve operatively coupled to the device; and a setting tool operatively coupled with the wireline, the setting sleeve, and the device to actuate the device via the setting sleeve to a set position in the borehole, the setting tool comprising:

an outer housing;

a gauge ring positioned to create a standoff between the setting sleeve and the outer housing of the setting tool to facilitate actuation and setting of the device;

a seal cap disposed at an opposite end of the outer housing from the gauge ring and having at least one metering port positioned such that an unsealed portion of the outer housing will fill with fluid via the at least one metering port as the setting tool is positioned within the borehole;

a tension member slidably and sealably mounted within the outer housing and through the seal cap and the gauge ring, the tension member having passages in communication between an interior of the tension member and a pressure chamber formed between the tension member and the housing; and a setting charge disposed in the interior of the tension member, the passages directing expanding gas to the pressure chamber upon initiation of the setting charge, the expanding gas driving the outer housing linearly with respect to the tension member to set the device while the metering ports discharge of the fluid from the unsealed portion of the outer housing, wherein the at least one metering port is configured to control the discharge of the fluid to limit stroke speed of the outer housing relative to the tension member to a selected stroke speed.

2. The system as recited in claim 1, wherein the device comprises a plug.

3. The system as recited in claim 1, wherein the device comprises a frac plug.

4. The system as recited in claim 1, wherein the tension member is initially held in position with respect to the outer housing by a shear member.

5. The system as recited in claim 1, wherein the at least one metering port comprises lateral passages extending between an interior and exterior of the outer housing.

6. The system as recited in claim 1, wherein the tension member comprises a piston portion slidably disposed along an interior surface of the outer housing, the piston portion being sealed with respect to the interior surface of the outer housing via a seal.

7. The system as recited in claim 1, wherein the setting tool is disposable.

8. A method to facilitate actuation in a borehole, comprising:

deploying a device, a setting sleeve, and a setting tool operatively coupled with the device via a wireline to a desired location in the borehole; and actuating the device to a set position in the borehole with the setting tool via the setting sleeve, the setting tool comprising:

an outer housing;

a gauge ring positioned to create a standoff between the setting sleeve and the outer housing of the setting tool to facilitate actuation and setting of the device;

a seal cap disposed at an opposite end of the outer housing from the gauge ring and having at least one metering port positioned such that an unsealed portion of the outer housing will fill with fluid via the at least one metering port as the setting tool is positioned within the borehole;

a tension member slidably and sealably mounted within the outer housing and through the seal cap and the gauge ring, the tension member having passages in communication between an interior of the tension member and a pressure chamber formed between the tension member and the housing; and a setting charge disposed in the interior of the tension member, wherein the step of actuating the device further comprises:

initiating the setting charge via a fire head coupled to the setting tool;

allowing expanding gas resulting from the setting charge to flow through the passages of the tension member into the pressure chamber; and using the expanding gas to drive the outer housing linearly with respect to the tension member to set the device while discharging the fluid from the unsealed portion of the outer housing with the at least one metering port, wherein the at least one metering port is configured to control the discharge of the fluid to limit stroke speed of the outer housing relative to the tension member to a selected stroke speed.

9. The method as recited in claim 8, wherein the device comprises a plug.

10. The method as recited in claim 8, wherein the device comprises a frac plug.

11. The method as recited in claim 8, wherein the tension member is initially held in position with respect to the outer housing by a shear member.

12. The method as recited in claim 8, wherein the at least one metering port comprises lateral passages extending between an interior and exterior of the outer housing.

13. The method as recited in claim 8, wherein the tension member comprises a piston portion slidably disposed along an interior surface of the outer housing, the piston portion being sealed with respect to the interior surface of the outer housing via a seal.

14. The method as recited in claim 8, wherein the setting tool is disposable.

* * * * *